US005096127A

United States Patent [19]

Young

[11] Patent Number: 5,096,127

[45] Date of Patent: Mar. 17, 1992

[54] APPARATUS FOR PRESSURIZED SCREENING OF A FIBROUS MATERIAL LIQUID SUSPENSION

[75] Inventor: Douglas L. G. Young, Nashua, N.H.

[73] Assignee: Ingersoll-Rand Company, Woodcliff Lake, N.J.

[21] Appl. No.: 570,859

[22] Filed: Aug. 22, 1990

[51] Int. Cl.[5] ..... B02C 13/18; B02C 23/36; B07B 1/20

[52] U.S. Cl. ..... 241/46.17; 162/55; 209/273; 241/74

[58] Field of Search ..... 209/268, 273; 210/413; 162/55; 241/46.17, 74

[56] References Cited

U.S. PATENT DOCUMENTS

| | | | |
|---|---|---|---|
| 2,908,390 | 10/1959 | Rich et al. | 210/413 X |
| 3,437,204 | 4/1969 | Clarke-Pounder | 209/273 |
| 3,458,038 | 7/1969 | Young | 209/273 X |
| 4,136,018 | 1/1979 | Clark et al. | 209/273 X |
| 4,267,035 | 5/1981 | Martin | 209/273 |
| 4,737,274 | 4/1988 | Jacobsen et al. | 209/268 |
| 4,749,474 | 6/1988 | Young | 209/273 |
| 4,832,832 | 5/1989 | Fujiwara et al. | 209/397 X |
| 4,941,970 | 7/1990 | Ahs | 209/270 X |
| 5,000,842 | 3/1991 | Ljokkoi | 209/273 |

FOREIGN PATENT DOCUMENTS

| | | | |
|---|---|---|---|
| 0631961 | 11/1961 | Canada | 210/413 |
| 59-32594 | 8/1984 | Japan | 209/273 |

*Primary Examiner*—Michael S. Huppert
*Assistant Examiner*—Edward M. Wacyra
*Attorney, Agent, or Firm*—Robert F. Palermo

[57] ABSTRACT

An apparatus, for pressurized screening of a fiber/liquid suspension to separate the fibrous fraction into an accepts portion and a rejects portion, has a housing having an inlet with a heavy and large material trap, an accepts outlet, a rejects outlet, and a dilution liquid inlet. A hollow cylindrical screen having an open top and bottom communicates with the fibrous suspension inlet chamber and the rejects outlet chamber. Accepts fibers in the suspension pass through apertures in the screen to the accepts chamber and are discharged through the accepts outlet. Rejects discharge through the rejects chamber. A rotor having at least four regions, a closed top, and a bottom mounted drive mechanism is coaxially mounted within the screen. Hydrodynamic pulses are induced in the suspension in the screening region by a pattern of bumps and/or depressions impressed upon the rotor surface. The fibrous suspension is maintained at a relatively constant consistency within the screening region by the pumping action of the rotor and by providing dilution liquid to counteract thickening of the suspension. A dynamic bar screening device directs stones and other large objects out of the fluid stream and into an annular trap and also deflocculates the suspension.

12 Claims, 3 Drawing Sheets

10
40
40
40
14
12
31
36
36
32
30
85
15
11
34
36
33
35
12
13
150

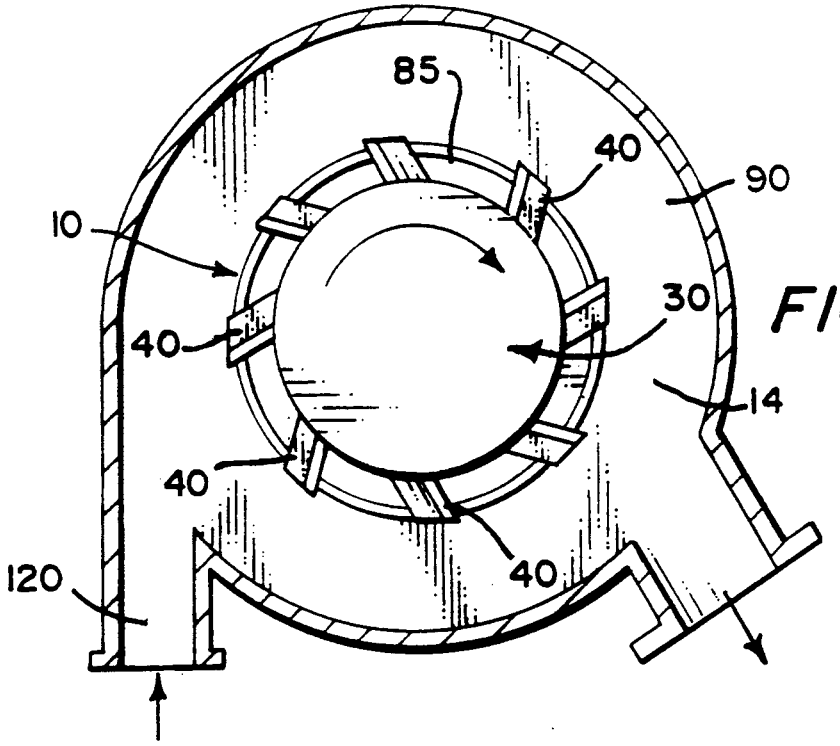
FIG. 3
FIG. 4
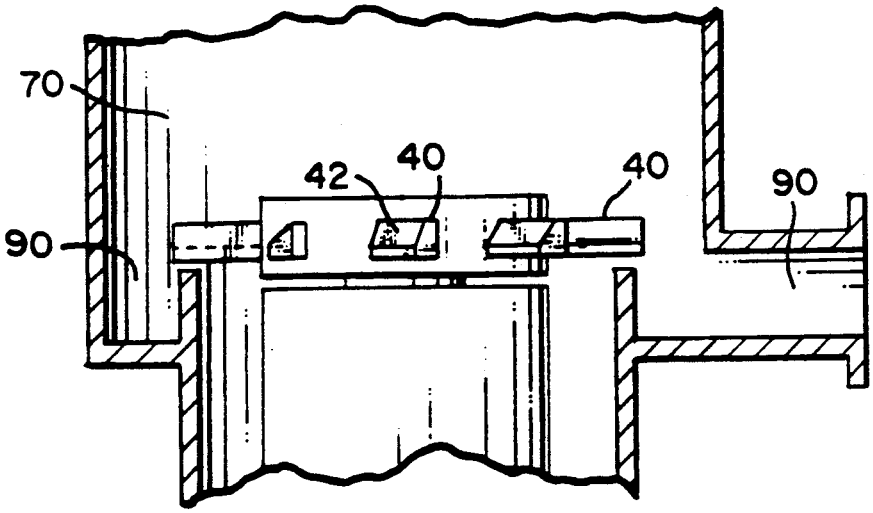

APPARATUS FOR PRESSURIZED SCREENING OF A FIBROUS MATERIAL LIQUID SUSPENSION

BACKGROUND OF THE INVENTION

This invention relates generally to pressurized screening of a fibrous material/liquid suspension and more particularly to pressurized screening of papermaking pulps.

Paper quality is directly determined by the quality of pulp used to make that paper. Characteristics effecting pulp quality include the type or source of pulp, the uniformity of the pulp fibers, the amount of foreign matter included in the pulp, and the completeness of fiber separation achieved during initial defibering such as is achieved by chemical digestion, mechanical pulping, or recycled paper pulping techniques. Pulp quality may be enhanced by screening to remove foreign matter, dirt, and groups of unseparated fibers.

A typical pulp screening device has a housing with a generally cylindrical shape into which the pulp suspension is fed. Within the housing and radially separated therefrom, is an annular screen within which, in turn, a rotor is generally coaxially mounted. The axis of the device is most commonly vertical although many screens have a horizontal axis. Between the rotor and the screen is a gap through which the feed suspension is axially passed for screening. Usually, the top of the screen is open while the top of the rotor is closed. The rotor is commonly driven from the bottom in order to impart a circular motion to the incoming pulp suspension. As the suspension passes through the gap between the rotating rotor and the stationary screen, it is subjected to a large number of hydrodynamic displacements which are caused by protrusions and/or depressions on the surface of the rotor. The resultant pressure pulses and turbulence help to break up fiber agglomerations (flocs) and to thereby improve screening efficiency. Also, because of the alternating high and low pressure pulses, there is a significant reduction of the tendency for blockage of the screen apertures by fiber agglomerations.

As the fiber suspension travels along the length of the screen, it thickens progressively due to the extraction of liquid along with the accepts fibers. If this thickening and accompanying floc formation becomes too pronounced it can plug the screen and prevent further screening operation. This thickening tendency, therefore, limits the axial length of screen apparatus which can be employed.

One approach to counteracting the thickening tendency has been to introduce dilution liquid at or near the area of the screen at which thickening begins to hamper the screening operation. This is usually in the vicinity of the midpoint of the screen length. Introduction of dilution liquid causes increased power consumption due to the necessity for accelerating the dilution liquid in the direction of rotor travel.

In general, it is desired to have the largest screening capacity per unit possible in order to provide simple screening systems which utilize the fewest screening units. Increases of capacity attained by increasing the diameter of the apparatus are limited due to the nonlinear increase of cost of manufacturing as the diameter is increased. Increases in capacity achieved by increasing the axial length of the screen and rotor are limited by the thickening tendency as the suspension passes along the screen.

In order to attain the maximum length for the screen and rotor while maintaining the screening efficiency, it is necessary to reduce or prevent the extraction of liquid along with the accepts fibers, or to provide sufficient dilution liquid to maintain the suspension consistency at a relatively constant level throughout the entire screening process. If dilution liquid is supplied, it must be supplied in such a way as to minimize the power consumption increase related thereto, otherwise, the power cost penalty may exceed the economic advantage of the higher capacity realized by utilizing a longer screen and rotor.

In fibrous material/liquid suspensions, there are a small number of stones, uncooked chips, woody chunks, or other foreign materials of varying sizes. In many cases, the sizes of these tramp materials are such that they will not pass through the screening chamber. Instead, they wedge between the rotor and screen where they can cause severe wear and damage and also inhibit the screening action.

Other factors which may reduce screening efficiency include failure to completely break up flocs, flocs formed in feed suspensions and damage to the rotor and/or screenplate by tramp materials.

The foregoing illustrates limitations known to exist in present pulp screening systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing an apparatus for screening a fibrous material/liquid suspension comprising a housing; a fibrous suspension inlet; a heavy and large material trap; means for directing heavy and large material objects into the trap; a hollow cylindrical screen below the fibrous suspension inlet; a rotor coaxially mounted within the screen and having at least four regions disposed along its length, the annular passage between the screen and the rotor defining a screening chamber; a dilution liquid inlet; and a rejects outlet.

The foregoing and other aspects will become apparent from the following detailed description of the present invention when considered in conjunction with the accompanying drawing figures.

BRIEF DESCRIPTION OF THE DRAWINGS

FIG. 3 is a partial sectional schematic plan view of the rotor of FIG. 2 illustrating the dynamic primary fluidizing and separating device of the present invention.

FIG. 4 is a partially sectional schematic elevation view of the dynamic fluidizing separator of FIG. 3.

DETAILED DESCRIPTION

Figure 1:
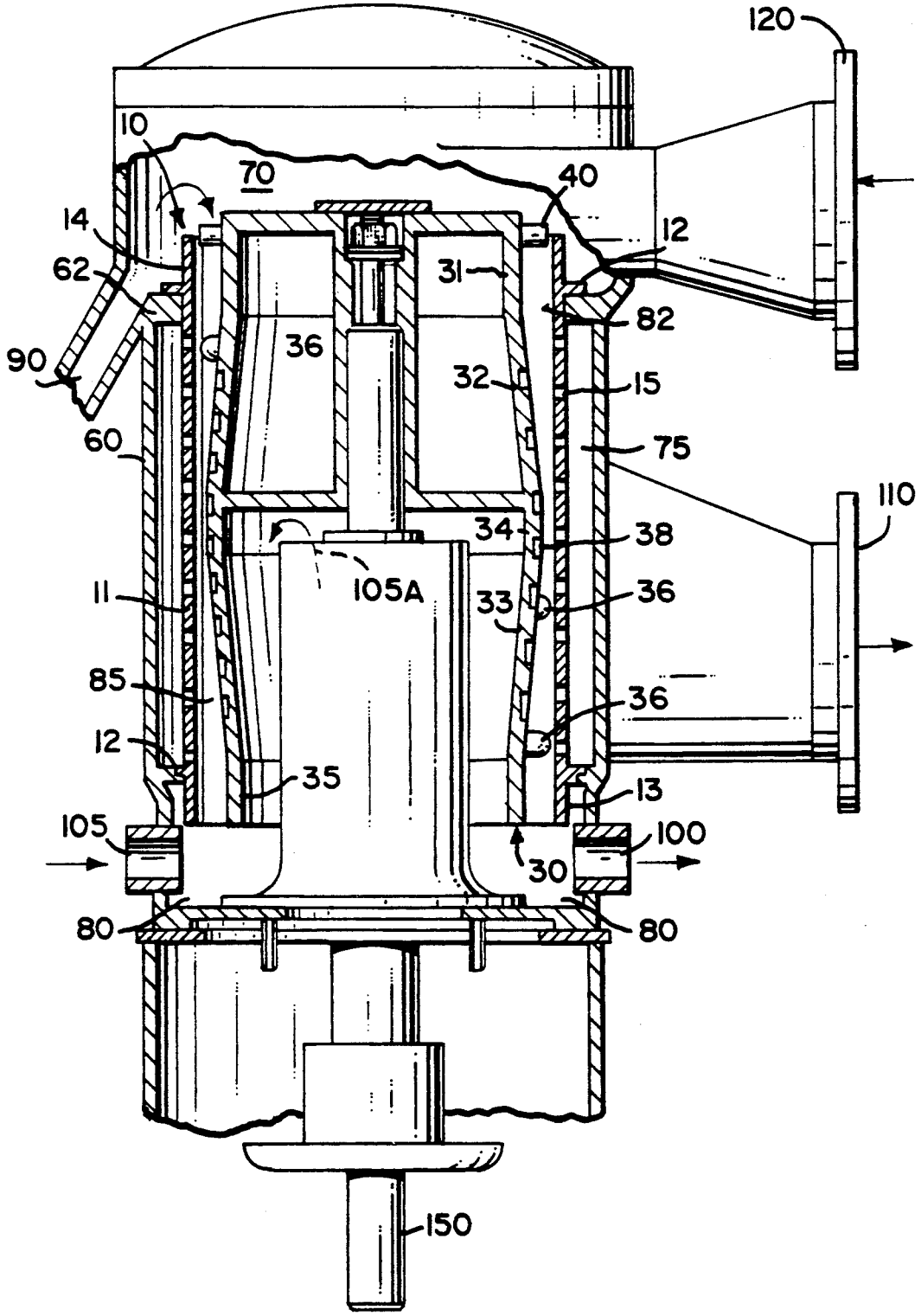
FIG. 1 is a vertical sectional schematic view of the fine pulp screening apparatus of the present invention.
Figure 2:
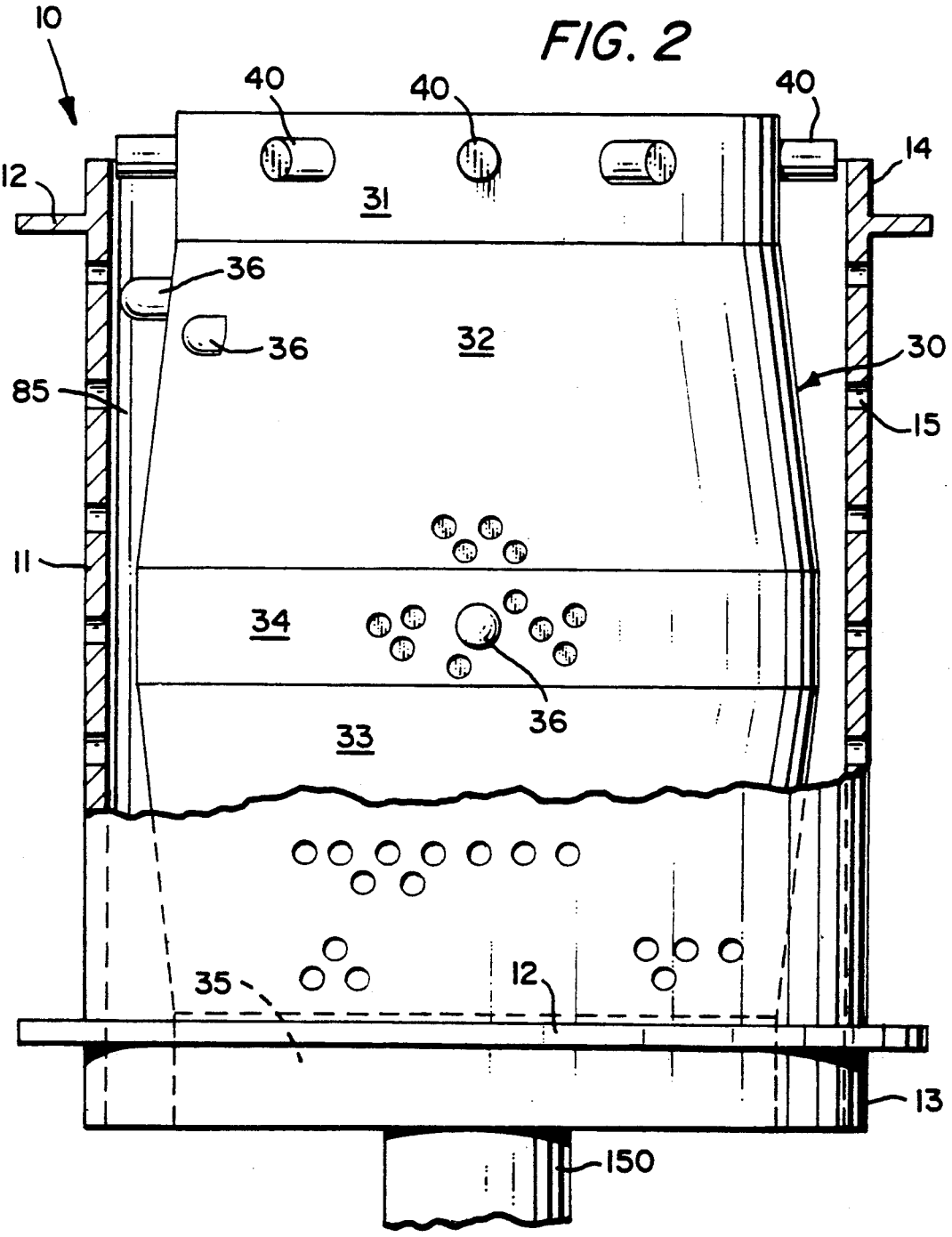
FIG. 2 is a vertical partial sectional view of the rotor and screen of the present invention.

FIGS. 1 and 2 show the housing 60, rotor 30, and screen 10. Housing 61 is generally cylindrical with a closed top and sealed construction so that it can operate under pressure. The fibrous material suspension is fed through suspension inlet 120 into inlet chamber 70 at the top of the housing 60. The suspension is fed tangentially into the inlet chamber 70 in order to begin the rotary motion desired for the suspension. This rotary motion tends to push heavy and large material to the outside of the chamber 70 where it is deposited in the trap 90. Chamber 70 is an annular trough bounded on the outside by housing 60, on the bottom by housing flange 62 and screen flange 12, and on the inside by the non-apertured upper extension 14 of the screen 10. From inlet chamber 70, the suspension enters the annular passage 82 defined by non-apertured screen extension 14 and upper cylindrical rotor extension 31. At the entrance to passage 82, is the dynamic fluidizer and prescreen which can be integral with the rotor or removable and which is composed of several bars 40 extending from the top of the upper cylindrical rotor extension 31, outwardly and preferably at a negative rake angle to the direction of rotation as shown in FIG. 3, into passage 82. These bars 40 may have a variety of shapes, two of which are shown in the figures. Rotor 30, which is closed at the top, consists of a substantially cylindrical body having five distinct regions arranged along its axis and is driven from below by a rotor drive, not shown, through shaft 150. The five regions of the rotor are defined by changes of rotor diameter, as seen in FIGS. 1 and 2, which show the rotor, in its preferred embodiment, having three cylindrical regions and two frustoconical regions. Because of the rotation of rotor 30, the bars 40 of the dynamic fluidizer and prescreen sweep the entrance to passage 82 so that any objects larger than a size determined by the spacing of the bars and the rotary speed of the rotor will be prevented by the action of the bars from entering annular passage 82 and will be propelled upward and outward where they will pass into trap 90. In addition to the screening function, bars 40 perform the additional critical function of deflocculating the suspension. This permits processing of higher consistency fiber suspensions than would otherwise be possible and increases screening efficiency. The length of passage 82 is determined by the requirements of the pulp suspension being processed. Thus, for hardwood pulps, passage 82 may be long, while for softwood pulps, it may be short. Accordingly, upper cylindrical rotor extension 31 and non-apertured screen extension 14 are made longer or shorter, as determined for the pulp processed in the mill.

Screening of the fibrous material/liquid suspension occurs in screening chamber 85 which is an annular axially disposed region defined by the apertured portion 11 of screen 10, and by upper and lower frustoconical sections 32 and 33, respectively, and central cylindrical section 34 of rotor 30. In screening chamber 85, the suspension is subjected to hydrodynamic displacements and resulting pulsations which are induced by rotor bumps 36 and/or rotor depressions 38 which are distributed about the rotor on the rotor surface abutting the screening zone 85. In addition to hydrodynamically breaking up fiber clumps, these pulsations cause momentary flow reversals through the screen apertures which provides additional breakdown of fiber clumps and prevents blockage of the apertures in screen portion 11. After fluidizing, or breaking down of the fiber clumps, the accepts fibers pass from screening chamber 85 through the apertures 15 in screen 10 into accepts chamber 75 and from there to accepts outlet 110. Along with the accepts fibers, a large quantity of liquid passes through the apertures 15 in the screen. This leads to thickening of the fiber suspension in screening chamber 85 and, thus, to decreased screening efficiency and lower screening capacity per unit. To counteract this thickening tendency, dilution liquid is provided through the dilution liquid inlet 105 or by inlet 105A through rotor pedestal into rejects chamber 80. From there, it passes through the annular smooth walled passage defined by the smooth lower cylindrical extension 35 of rotor 30 and the lower non-perforated screen extension 13. Lower frustoconic portion 33 of rotor 30 induces a flow of the dilution liquid, together with rejects, composed of a mixture of acceptable fiber and rejectable materials, and reject liquid, through the passage defined by lower cylindrical rotor extension 35 and lower non-perforated screen extension 13 upward in screening chamber 85 toward the center of perforated portion 11 of screen 10, which mixes with the suspension, thereby lowering the consistency on the apertured portion 11. At the same time, upper frustoconic section 32 of rotor 30 induces increased flow of the suspension into the upper portion of screening chamber 85. This increased flow of the suspension also provides rapid axial transport and mixing which is necessary to avoid inordinate thickening against the apertured upper portion of the screen and also avoids the attendant decrease of screening efficiency. Because of these induced flows toward the center of the screening area the consistency of the fibrous suspension at the surface of apertured portion 11 of screen 10 is maintained at a relatively constant value throughout the screening process. In addition, the upflow of dilution liquid together with entrained good, acceptable fibers in the rejects provides a recycle opportunity for the acceptable fibers in the rejects, thereby providing an additional opportunity for acceptance of good fibers and a greater yield of accepts through the process. Lower cylindrical rotor extension 35 maintains rotary motion in the upflowing mixture of dilution liquid and reject suspension so as to minimize additional power consumption required for accelerating the dilution liquid.

The rejects flow which is eventually discharged through rejects outlet 100 contains less "good" acceptable fibers due to the aforementioned recirculation. Both rejects outlet 100 and accepts outlet 110 are provided with valves (not shown) to permit flow control and pressure control within the system.

The relative lengths of the various rotor portions are dictated by the system requirements and those of the pulp being processed. Thus, design of the system requires a balancing, or optimization, of the various, sometimes conflicting, effects. Ideally, the design of the rotor will be such that power consumption will be minimal, and suspension thickening will be well controlled; thereby providing maximum acceptable fiber recovery at the lowest energy cost. The degree of taper of frustoconical sections 32 and 33 of rotor 30 is determined by a balance of the "pumping action" required by the suspension and provided by the taper versus the power consumption determined by the size of the rotor bumps 36. In FIG. 2, it can be seen that the height of the rotor bumps increases in direct proportion to the distance from the narrowest part of the screening chamber 85. This is because the bumps 36 are so sized as to provide a constant small clearance between the bumps and the apertured portion 11 of screen 10. Therefore, the bumps 36 at the central cylindrical part 34 of rotor 30 must be smaller than bumps 36 at the narrow ends of frustoconical sections 32 and 33 of rotor 30 next to the non-apertured sections 13 and 14 of screen 10. This means that, as the degree of taper of the frustoconical sections increases or as their lengths increase at a given taper, the bumps 36 required at the narrow end in order to maintain the constant small clearance from apertured portion 11 of screen 10 must be longer. This increase length presents a greater projected area for the bumps and, consequently, a greater power consumption in order to move those bumps through the fibrous material/liquid suspension. Note that bumps may have any of a variety of forms—ellipsoidal, cylindrical, airfoil, paddle shapes, or combinations of shapes.

Since actions within the tapered sections counteract thickening, it stands to reason that the longest, steepest tapers possible in view of the power consumption effects of the large rotor bumps 36 would be desirable. The central cylindrical portion of the rotor may only be as long as will not produce unacceptable thickening in the screening chamber 85 at that point. In summary, the proportions of the various rotor sections are empirically determined by consideration of the factors previously mentioned.

FIG. 3 shows a partially sectional schematic plan view of the rotor 30 illustrating the dynamic bar fluidizing and prescreening device. The bars 40 are shown here having a second, different configuration from those of FIG. 1 and mounted at an angle of approximately 45 degrees to the radius of the rotor. This actual angle is determined by the speed of the rotor and the mass of the objects which the dynamic bar screen is designed to remove. The pulp suspension is tangentially fed through suspension inlet 120 and into the inlet chamber 70, and tramp material separated by the rotary motion is removed by way of heavy and large material trap 90. The non-apertured screen extension 14 forms the boundary between trap 90 and feed deflocculating and accelerating zone passage 82.

The fragmentary view presented in FIG. 4 shows an alternative embodiment of the rotor of FIG. 3 in a sectional schematic elevation view. In this view, the angled face 42 of bars 40 and the radial extension of bars to cover the entrance to annular passage 82 can be seen.

Summarizing the operation of the invention, the fibrous material/liquid suspension enters fine screen housing 60 through suspension inlet 120 in a tangential direction into inlet chamber 70. This entry direction imparts a rotational motion to the suspension and reduces the amount of energy necessary to accelerate the suspension to the proper screening velocity. An additional feature of the tangential entry is that it imparts centrifugal force to some large heavy objects which will tend to pass into heavy and large material trap 90. The suspension then enters passage 82 at the entrance of which it is acted upon by bars 40 of the dynamic bar screen device. These bars, in addition to generating centrifugal force, do by their spacing, angle, and velocity of rotation, exclude all solid objects larger than some limit size from entering passage 82 and screening chamber 85 by striking them and deflecting them and driving them upward and outward so that such solid objects pass into trap 90. Bars 40 also deflocculate the suspension so that it will pass through passage 82 into screening chamber 85 in a condition conducive to efficient screening. The length of passage 82 is determined by the nature of the pulp being screened—short passage for softwood pulp and long passage for hardwood pulp. As the suspension passes down the annular screening chamber 85, the taper of upper frustoconical rotor section 32 promotes additional flow and mixing to transport the suspension along the apertured portion 11 of screen 10 at a speed sufficient to counteract thickening tendency of the suspension.

The central cylindrical section 34 of rotor 30 is shown as having a significant vertical dimension in FIGS. 1 and 2. This conforms with the generally preferred rotor configuration having five regions disposed along its axis. In fact, this section may be a mere line at the intersection of frustoconical sections 32 and 33, or it may be a smooth curve joining the two conical sections. The actual dimension and nature of that section is empirically determined for the application intended. The main limitation on its length is the thickening tendency of the suspension being treated. At some axial level of screening chamber 85, thickening reaches its maximum tolerable extent. From this point downward, frustoconical section 33 of rotor 30 begins its taper inward. This taper induces recirculation flow of rejects and dilution liquid, introduced, for example, as shown, through dilution liquid inlet 105 and through rejects chamber 80, upward into screening chamber 85 where it counteracts thickening of the fibrous material/liquid suspension being screened. As the suspension travels down apertured portion 11 of screen 10 the fiber content is decreasing along with the liquid content. Therefore, the consistency remains approximately the same. In the induced upward flow of dilution liquid, is included a number of good acceptable fibers with unacceptable rejects fiber bundles which are rescreened in the lower portion of screening chamber 85.

As described, this invention provides high efficiency fractionation of fibers primarily due to the control of thickening in the screening process through use of the pumping action of the tapered regions of the rotor. The use of dilution, for example, through the rejects chamber, in which the suspension already has a circular path of motion, minimizes the power consuming effect of dilution and also recycles a significant fraction of the rejects back into the screening chamber where they are rescreened to accept a greater portion of good acceptable fibers. As a result of this rejects reprocessing, this invention results in a larger portion of the acceptable fibers contained in the feed suspension being accepted than is possible with conventional screening systems.

What is claimed is:

1. A pressurized apparatus for screening a fibrous material/liquid suspension to separate the fibrous fraction thereof into an accepts portion and a rejects portion, comprising:

a vertically oriented housing having a fibrous suspension inlet, a heavy and large material trap, an accepts outlet, a rejects outlet, and a dilution liquid inlet;

a hollow cylindrical vertical screen having an open top in fluid communication with the fibrous suspension inlet, perforations through which accepts fibers can pass to the accepts outlet, and an open bottom in fluid communication with the rejects outlet and the dilution liquid inlet;

means for dividing the housing into an inlet chamber, a screening chamber, an accepts chamber, and a rejects chamber;

a vertical rotor having at least four regions defined by differing diameters of said rotor, a closed top, and a length longer than that of the screen, the rotor being coaxially mounted within the screen and radially spaced from the screen to provide said screening chamber for the suspension;

means for creating hydrodynamic displacements and resultant pulses within the fibrous suspension against the screen to enhance separation efficiency;

means for preventing thickening of the fibrous suspension and for maintaining a substantially constant suspension consistency within the screening chamber; and means for directing heavy and large material objects into the trap and for deflocculating the feed suspension.

2. The screening apparatus of claim 1, wherein the means for dividing the housing comprises cooperating flanges on the housing and screen and the closed top surface of said vertical rotor.

3. The screening apparatus of claim 1, wherein the means for creating hydrodynamic pulses comprises a pattern of bumps and depressions disposed upon the circumferential surface of said rotor.

4. The screening apparatus of claim 1, wherein the means for preventing thickening of the suspension and for maintaining a constant suspension consistency comprises upper and lower tapered regions on the rotor which provide a pumping effect to draw liquid downward and upward into the screening chamber; and dilution liquid which is fed into said rejects chamber through the dilution liquid inlet to counteract thickening tendencies of said suspension.

5. The screening apparatus of claim 1, wherein the means for directing heavy and large material objects into the trap comprises a tangential fibrous suspension inlet which promotes circular flow in the suspension; and rotor motion which accelerates flow of the suspension and increases centrifugal forces.

6. The screening apparatus of claim 1, wherein the means for directing heavy and large material objects into the trap and for deflocculating the feed fibrous suspension comprises a dynamic fluidizing prescreen fixed to the inlet end of the rotor so that it sweeps substantially over the entrance to the screening chamber, deflects objects which exceed a threshold size outward to the trap, and deflocculates the feed fibrous suspension.

7. In an apparatus for screening a fibrous material/liquid suspension to separate the fibrous fraction thereof into an accepts portion and a rejects portion, including a vertical housing having a heavy material trap, and means for defining in the housing, a screening chamber, the improvement comprising:

a vertical rotor having at least four regions, defined by differing diameters of said rotor along its axis, which provide pumping means for preventing thickening of the suspension and for maintaining a substantially constant suspension consistency within the screening chamber; and means for directing heavy material objects into the heavy material trap.

8. The apparatus of claim 7, further comprising:

means for deflocculating the feed suspension to improve screening efficiency.

9. The apparatus of claim 7 further comprising:

means for creating hydrodynamic displacements and resultant pulses within the fibrous suspension against a wall of the screening chamber to improve screening efficiency.

10. A pressurized apparatus for screening a fibrous material/liquid suspension to separate the fibrous fraction thereof into an accepts portion and a rejects portion, comprising:

a substantially cylindrical housing having its axis vertically oriented and having a fibrous suspension inlet feeding into an inlet chamber in top portion thereof and accepts and rejects outlets below;

a heavy and large material trap directed outwardly and downwardly from said inlet chamber;

a hollow cylindrical screen having upper and lower flanges, non-perforated upper and lower extensions, and a perforated center section, said upper extension providing a radially inner wall of the inlet chamber and a radially outer wall of a fluidizing passage, said lower extension providing an outer wall for a passage performing functions of liquid velocity maintenance, rejects discharge, and dilution liquid admission, said perforated center section providing an outer wall for a screening chamber and an inner wall for an accepts chamber which is bounded at its upper and lower limits by said upper and lower flanges;

a bottom driven vertical rotor, coaxially positioned within said hollow cylindrical screen and having a closed top and at least four regions defined by differing diameters of said rotor, which, together with said screen, define said fluidizing passage, said screening chamber, and said liquid velocity maintenance, rejects discharge and dilution liquid admission passage;

means for fluidizing said fibrous suspension and for propelling heavy and large material in said fibrous suspension upward and outward so that it enters said heavy and large material trap;

means for producing substantially radial hydrodynamic displacements and resultant pulsations of the fiber suspension in the screening chamber; and a dilution liquid inlet feeding into a rejects chamber located in the housing below the bottoms of the rotor and screen.

11. The pressurized apparatus of claim 10, wherein the means for fluidizing said fibrous suspension and for propelling heavy and large materials upward and outward comprises a tangentially directed fibrous suspension inlet and a plurality of rigid bars mounted at an entrance to the fluidizing passage on a first region of said rotor such that they project radially outward from said rotor at a negative rake angle to the direction of rotation.

12. The pressurized apparatus of claim 10, wherein the means for producing substantially radial hydrodynamic displacements comprises an array of bumps and depressions on the regions of said rotor located within the axial limits of said screening chamber.

* * * * *